US006049905A

United States Patent [19]

Owens

[11] Patent Number: 6,049,905

[45] Date of Patent: Apr. 18, 2000

[54] PERSONAL PROTECTION WRIST SHIELD

[76] Inventor: Calvin E. Owens, 7829 Baseline Rd., Melba, Id. 83641

[21] Appl. No.: 09/175,808

[22] Filed: Oct. 20, 1998

Related U.S. Application Data

[60] Provisional application No. 60/064,750, Oct. 20, 1997.

[51] Int. Cl.[7] ..... A41D 13/08

[52] U.S. Cl. ..... 2/16; 2/162; 2/910; 602/21

[58] Field of Search ..... 2/16, 22, 159, 2/161.1, 162, 170, 455, 910; 602/21

[56] References Cited

U.S. PATENT DOCUMENTS

| | | | |
|---|---|---|---|
| 1,351,731 | 9/1920 | Baldwin | 2/16 |
| 3,446,880 | 5/1969 | Enicks | 264/45 |
| 5,526,531 | 6/1996 | Olson et al. | 2/16 |
| 5,769,804 | 6/1998 | Harris et al. | 602/21 |
| 5,787,501 | 8/1998 | Coleman | 2/16 |

*Primary Examiner*—Gloria M. Hale
*Assistant Examiner*—Tejash D Patel
*Attorney, Agent, or Firm*—Ken J. Pedersen; Barbara S. Pedersen

[57] ABSTRACT

The invention is a sturdy shield with a generally U-shaped curved piece adapted to fit for several inches along the underside/little finger side/ulna side of the wrist. Near the middle of the U-shaped curved piece is a generally perpendicular ridge, or striking edge, depending vertically between about ¼" and ¾", and extending horizontally between about 2" and 6" along the length of the wrist. The U-shaped curved piece is secured to the wrist by any sturdy conventional means, for example, by an adjustable strapping means which passes over the top side/thumb side/radius side of the wrist. A shorter, wristwatch style is envisioned, as well as a longer, forearm length version.

12 Claims, 4 Drawing Sheets

PERSONAL PROTECTION WRIST SHIELD

DESCRIPTION

This application is a conversion of, a continuation-in-part of, and claims priority from, co-pending provisional application Ser. No. 60/064,750, filed on Oct. 20, 1997 with the same title, which application is hereby incorporated by reference. This application also incorporates the Disclosure Document signed by Calvin E. Owens on Apr. 3, 1997, thereafter filed with the Patent and Trademark Office.

BACKGROUND OF THE INVENTION

1. Field of the Invention

This invention relates generally to the field of tools for personal self-protection. More specifically, this invention relates to a wrist shield with a raised striking edge for defending against and discouraging personal physical attacks and other aggressive acts.

2. Related Art

Law enforcement officers, for example, are often the objects of serious personal attacks. Often they must interject themselves into stressful situations which may turn violent, like domestic fights, arrests for intoxication or stops and searches of suspects for violent crimes or drug trafficking. All too often, law enforcement personnel are themselves the victims of the ensuing violence. Commonly, for example, police men and women are shot, stabbed, clubbed, scratched, kicked, and bit in and around the hands and wrists, usually because these parts of the body are first extended or held up by the officer in self-defense.

All too often, law enforcement personnel are put at risk by an adversary being able to grab and snatch away the officer's own service pistol. Statistically, if an adversary is able to reach and hold the officer's pistol, the chances of a fatal resolution, with either the adversary or the officer being shot to death with the pistol, are greatly increased. Therefore, there is an important need to provide law enforcement personnel with the means to immediately stop the handhold of an adversary on the officer's pistol. Also, there is an important need to provide law enforcement personnel with the means to protect their wrists and hands from the attack of an adversary. This invention addresses these needs.

SUMMARY OF THE INVENTION

The invention is a sturdy shield with a generally U-shaped curved piece adapted to fit for several inches along the underside/little finger side/ulna side of the wrist. Describing the shield in a position on the forearm when the hand is extended, like to make a hand-shake, for example, there is a ridge or "striking edge" extending along, at or near the crest or peak of the U-shaped curved piece, the ridge being generally perpendicular to the curved piece outer surface, preferably depending vertically between about ¼" and ¾", and preferably extending horizontally between about 2" and 6" along the length of the wrist. That is, if the curved piece is considered to be part of a cylinder, or cone, the striking edge extends radially outward from the curved piece outer surface, and it extends axially along the curved piece outer surface. The U-shaped curved piece is secured to the wrist by any sturdy conventional means, for example, by an adjustable strapping means which passes over the top side/thumb side/radius side of the wrist.

Two other embodiments are also explicitly envisioned. The first is smaller version where the U-shaped curved piece is of a reduced length, preferably less than 2", the width of a large wristwatch. This version would also have a shorter striking edge, and would preferably have only one strap. Being a smaller size has the added benefits of being more comfortable to wear and being less obvious and threatening to civilians. A standard watch could also be integrated into the strap of the embodiment giving the user added utility, or a watch band could be placed substantially over the shield.

The second alternate version has a U-shaped curved piece of an extended length, extending from the wrist to near the user's elbow. Preferably such a version will be approximately eight inches long, having a longer striking edge and three or more straps. Such a version would offer the user more protection from the blows of an aggressor, and would assist the user in other ways, for instance a police officer would be able to use the device to break a window and then rake the window frame with the device so as to remove glass shards from the frame.

Preferably, the U-shaped curved piece is tapered, narrowing substantially from its proximal/forearm end to its distal/hand end to fit comfortably with the natural narrowing of the arm between the forearm and the hand. Also preferably, the inside of the U-shaped curved piece next to the skin of the wrist is padded for comfort and for protection of the wrist.

DESCRIPTION OF THE PREFERRED EMBODIMENTS

Figure 1:
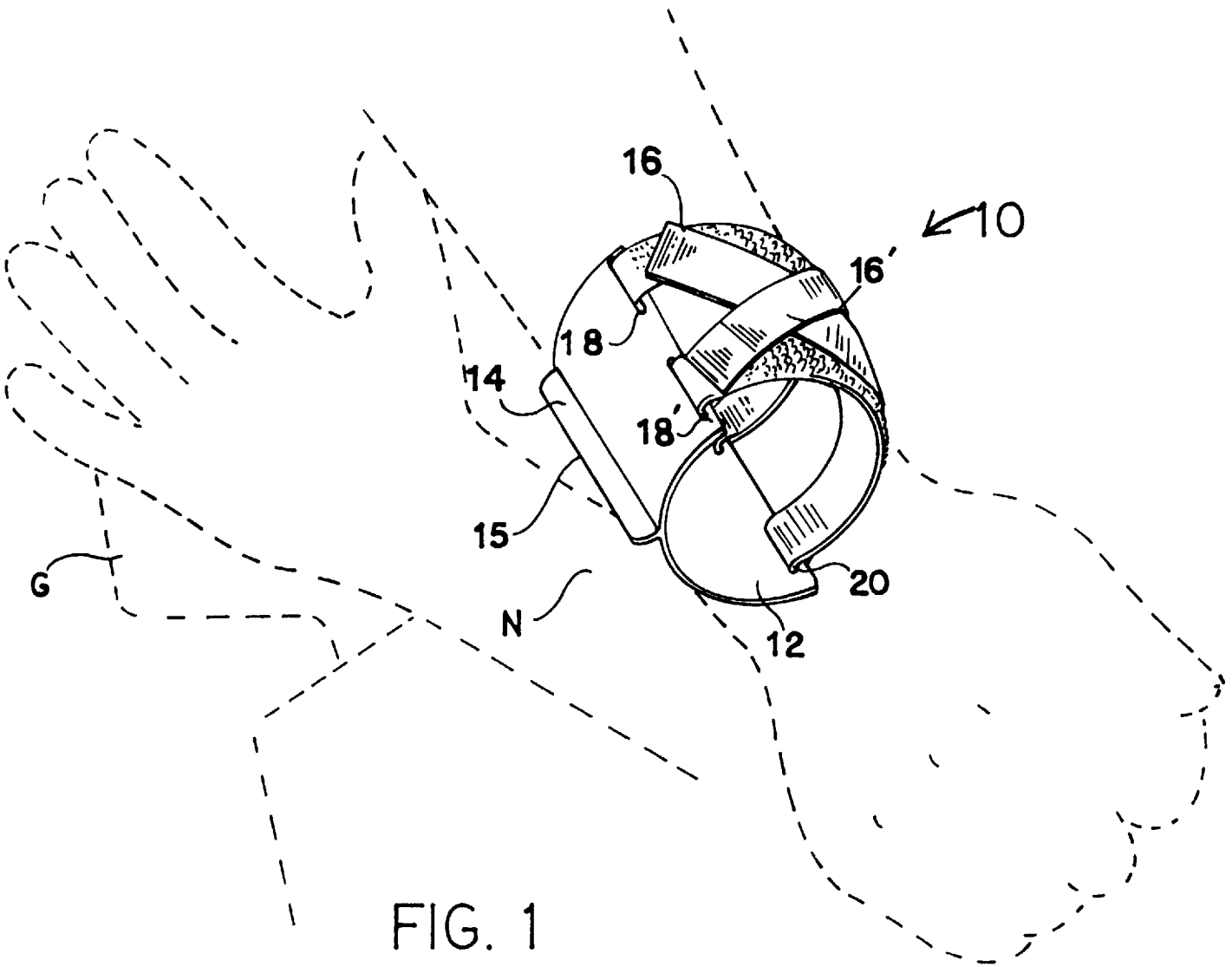
FIG. 1 is a right side, perspective view of one embodiment of the invention, showing the wrist shield in use.

Referring to the Figures, there is depicted generally at 10 one, but not the only, embodiment of the invented wrist shield.

The wrist shield 10 is an elongated, generally U-shaped, curved piece 12 adapted to extend and fit for several inches along the underside of a human wrist. This side of the wrist is also known as the little finger side, or ulna side (after the lower forearm bone which is nearby), of the wrist. The wrist shield 10 has a wrist side portion or wrist side surface 50 and an outside portion or wrist outside surface 60, and is preferably tapered along its length, such tapering shown in FIG. 3.

Preferably, the wrist shield 10 is made of a metal, for example a stainless steel, for strength and durability. However, the shield 10 may also be made of a strong and durable plastic, or of a composite material, such as a ceramic. Or, the shield 10 may be made of metal, and covered with a thick, soft coating of plastic or rubber for good gripping and comfort characteristics, and to allow use of a non-stainless metal in the shield 10. The shield 10 must be able to withstand contact from the clubs, knives, teeth and fingernails of aggressors, as well as contact by the wearer upon the body of an aggressor.

In the case of a metal shield 10, the U-shaped curved piece 12 may be made by first cutting the pattern from, for example, a 1/32" thick sheet of steel, and forming the curved piece 12 by pressing or stamping it onto, or into, a jig to create the desired shape shown in the drawings. Alternatively, the formed curved piece 12 may be covered with a thick, soft coating of plastic or rubber by dipping it, for example, in a vat containing the covering material in liquid form. Then, the desired final form of the covered curved piece 12 may be obtained by drying or thermal-setting the covering material on its surface.

In the case of a plastic shield 10, the U-shaped curved piece 12 may be made by injection molding a molten precursor, for example, or by thermo-forming or vacuum-forming a cut sheet of plastic material.

In any event, when the curved piece 12 has been finally formed, it fits easily around the wrist of the wearer. In order to accomplish different wearer wrist, sizes, different sizes of curved piece 12 may be offered, for example, small (including women and adolescent or smaller males), medium and large. A small size shield 10 may be said to include a small-diameter, tapered, approximately-half-cylinder curved piece 12. Likewise, medium and large shields 10 have medium and larger diameter, respectively, tapered approximately-half-cylinder curved pieces 12. In addition, the axial lengths and the amount of taper of each shield 10 may be varied to better fit different individuals' forearms.

Figure 3:
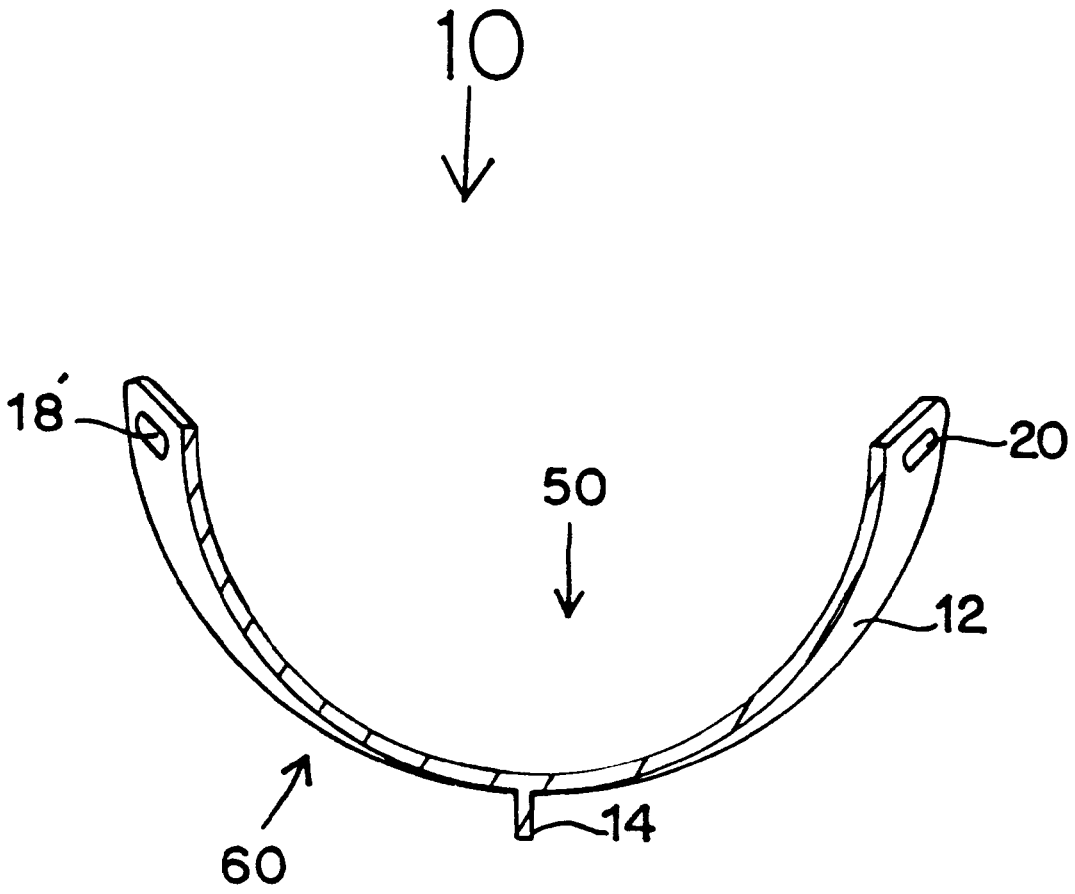
FIG. 3 is a front, cross-sectional view of the embodiment depicted in FIG. 2B, except with the strapping removed.

U-shaped curved piece 12 has a generally perpendicular ridge, or striking edge 14, depending vertically outward between about ¼ inch and ¾ inch from near the middle of the outside portion 60, when viewed as in the position in FIG. 3 (which is similar to a position on the forearm when the arm is extended as if in a handshake). Edge 14 may be thin and sharp in order to be more aggressive and punishing, or the edge 14 may be thicker and rounder to be less so. Preferably, edge 14 protrudes about ⅜ inches from the curved piece outer surface and has a width of about ⅛ inch created by folding and doubling over a portion of the sheet steel during manufacture of the curved piece 12.

Preferably, edge 14 the ridge or extends horizontally into the page in (FIG. 3) along the bottom side of curved piece 12, between about 2 inches and 6 inches. As shown in FIGS. 1 and 3 to best advantage, the preferred shield 10 has a single ridge (striking edge 14) which includes a generally straight distal edge 15 at its outer extremity that runs parallel to the axial length of the curved piece 12. This straight distal edge 15 makes striking contact with the aggressor, as discussed later in the Description. However, edge 14 may be shorter or longer than the length of curved piece 12. That is, for example, curved piece 12 may be 3 inches long, and edge 14 may be 2 inches or 4 inches long—extending shorter than the curved piece 12 or longer than it, respectively. Preferably, edge 14 is rounded at its ends to prevent catching, snagging or tearing of materials which come into contact with it.

Edge 14 may be formed with curved piece 12 when the curved piece is made, or formed separately and connected to curved piece 12 near its middle portion, with edge 14 extending generally outward from the middle outside 60 portion of curved piece 12. For example, edge 14 may be welded to a curved bracelet, or edge 14 may be slid in and locked into a curved bracelet.

U-shaped curved piece 12 may be secured to the wrist of the wearer in any conventional manner by a wrist attachment 44. Preferably, the wrist attachment 44 is an adjustable strapping means as shown in the drawings. Straps 16 and 16' are secured to one side of curved piece 12, for example, at slots 18 and 18', respectively. Then, the straps are crossed in an "X" pattern, and passed through a set of slots, 20 and 20' on the other side of curved piece 12. Then, the straps are folded back on themselves and secured tightly, for example, by means of a hook and loop fastening system located partly near the fixed end of the straps near slots 18 and 18', with the other part being located near the free end of the straps. Alternatively and preferably, the two straps are secured on different sides of curved piece 12, for example, at slots 18' and 20', and crossed, passing through slots 20 and 18, respectively and then being folded back on themselves in opposite directions, as shown in FIG. 1. This latter technique minimizes the chance that both straps will be knocked loose from a single blow in one direction.

Preferably, the U-shaped curved piece 12 tapers or narrows in diameter substantially from its proximal/forearm end to its distal/hand end. For example, for a curved piece 12 three inches long along the wrist, the proximal/forearm end may be 3 inches wide across the top of its open end (i.e., from side edge to side edge near the proximal edge), and 2 inches wide across the top of its open distal/hand end (i.e., from side edge to side edge near the distal edge).

Also preferably, the inside of the U-shaped curved piece next to the skin of the wrist, the wrist side portion 50, may be padded for comfort and for protection of the wearer's wrist. The padding may be an extra thick coating of dipped-on plastic or rubber on this inside surface region. Or, the padding may be a separate pad of foam covered with fabric glued or otherwise attached to the inside of the curved piece 12.

In use, the wearer secures a wrist shield 10 of this invention on one or both wrists. The shield 10 preferably may be on the inside or outside of a long-sleeve shirt or jacket. When necessary to defend against an attempt by an aggressor to grab the officer's gun, the wrist shield 10 is brought sharply down with the same action as an open-handed Karate chop, for example, as shown in FIG. 1. The wearer preferably directs the chop so that striking contact is made by the striking edge 14 with the aggressor's hand or wrist, preferably in the area (N) of the aggressor's exposed radial nerve extending between about 2 inches and 4 inches proximal of the wrist at the top-side/thumb-side/radius side of the wrist. This contact hurts and numbs the wrist of the aggressor, encouraging him/her to release the hold on the officer or on the officer's gun (G) and to stop the attack.

Also, the wrist shield 10 may be used as a more aggressive offensive weapon by the wearer, for example, when needed to actively stop an aggressor. In these more aggressive moves, the wearer executes outwardly-extending chops, with his/her arm(s) that hold(s) the wrist shield 10, to various key nerve, muscle and bone locations on the body of the aggressor.

Figure 2A:
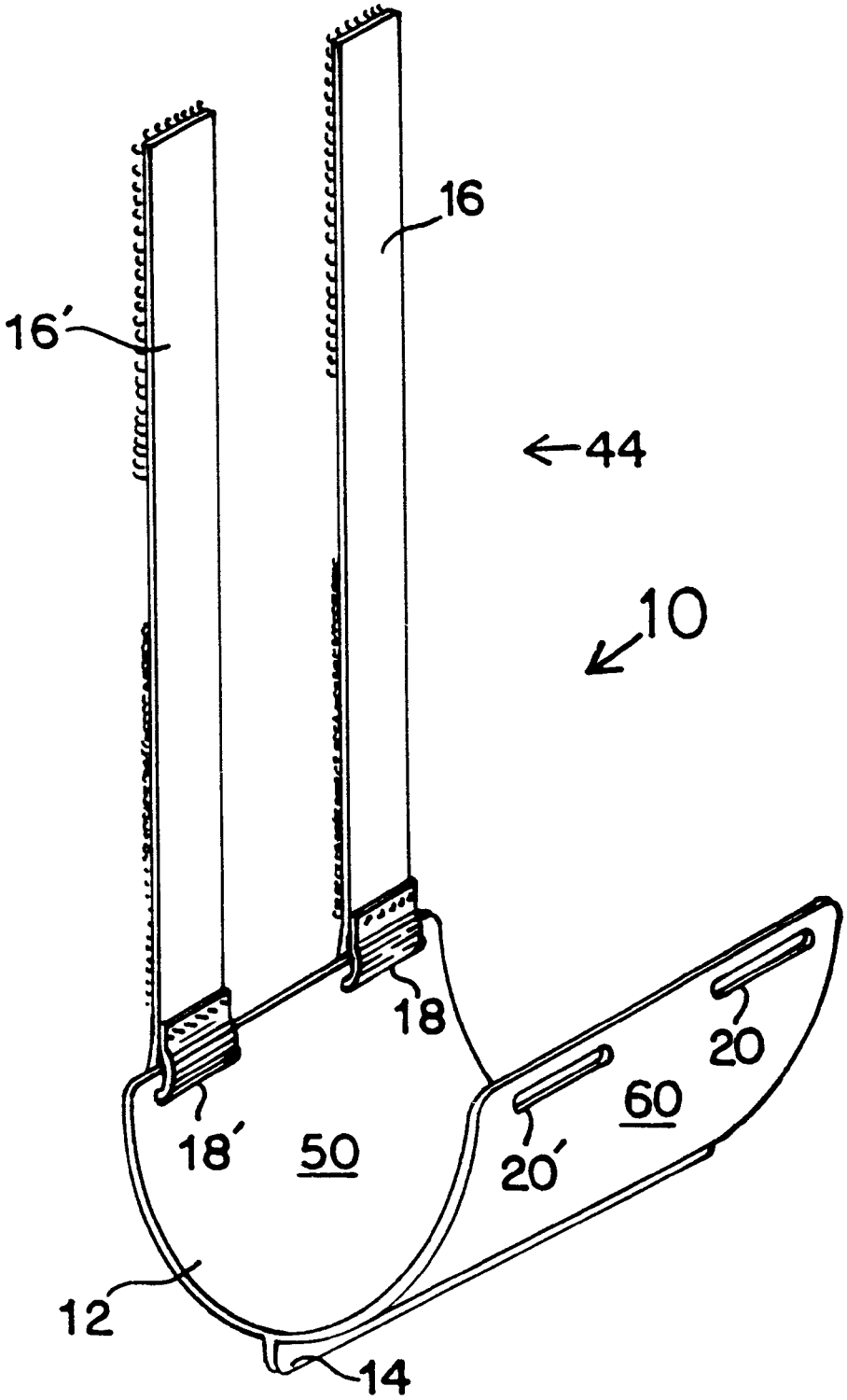
FIG. 2A is a top, left side perspective view of the embodiment depicted in FIG. 1, except showing the wrist shield removed from the wrist.
Figure 2C:
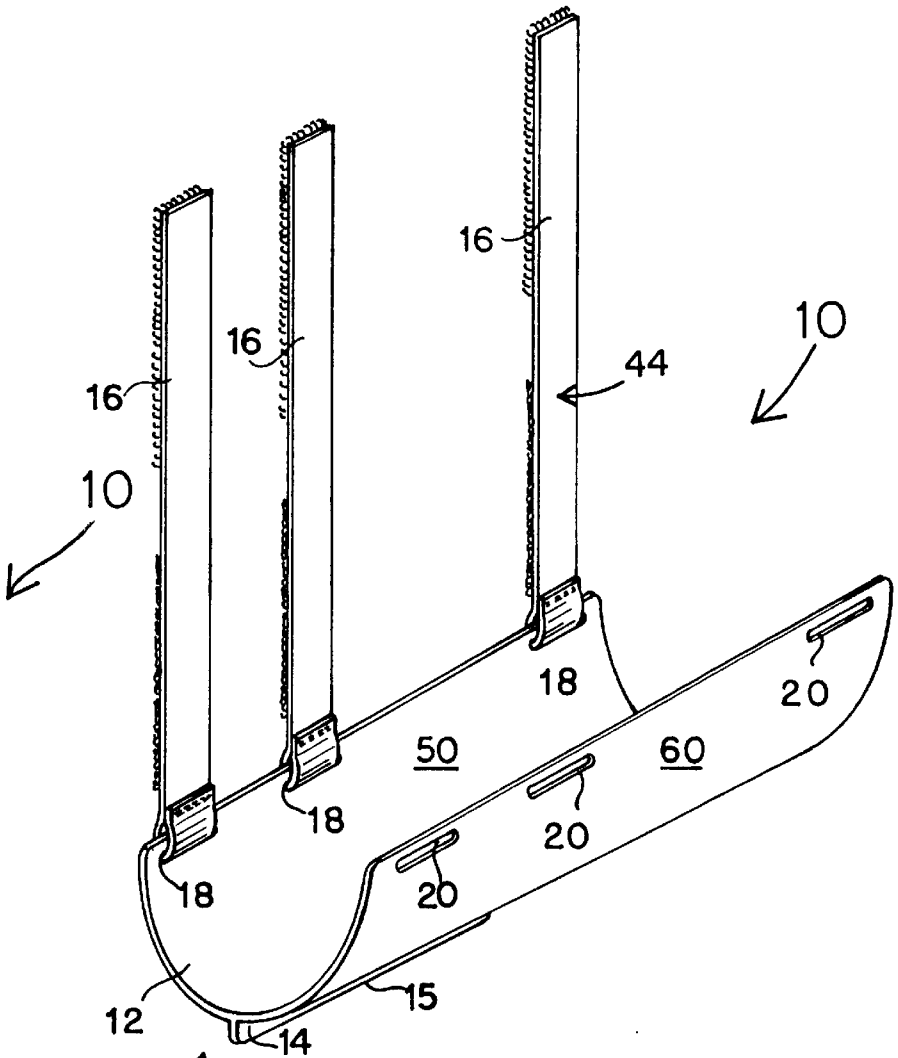
FIG. 2C is a top, left side perspective view of another embodiment of the present invention, except showing the wrist shield removed from the wrist.
Figure 2B:
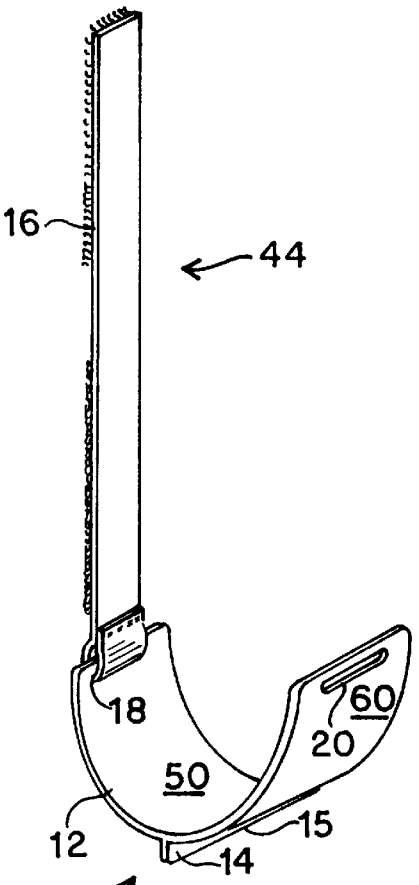
FIG. 2B is a top, left side perspective view of another embodiment of the present invention, except showing the wrist shield removed from the wrist.

Another embodiment, shown in FIG. 2B, envisioned by the inventor is a smaller version of the present invention, preferably the size of a standard wristwatch. This embodiment comprises an U-shaped curved piece 12 of a length of less than or equal to about 2 inches long, with a correspondingly sized edge 14, for instance a 1½ inch long edge 14 on a 2 inch long curved piece 12. This embodiment may only need a singular strap 16. This embodiment may alternatively, contain a wristwatch within its strap(s) 16, so that the embodiment would have the edge 14 of the present invention on the underside/little finger side/ulna side of the wrist, and a watch on the upperside/thumb side/radius side of the wrist.

Another embodiment, shown in FIG. 2C, envisioned by the inventor is a larger version of the present invention. This version comprises an U-shaped curved piece 12 of a length of greater than 3 inches, preferably eight inches long. This version will from the user's wrist to rear the user's elbow. This version will have a corresponding edge 14 that may extend the length of the user's forearm, may extend only near the user's wrist, or may be of another length. As such, this version may require additional straps 16 along the length of the device, preferably this number is three. This version has the added benefit of protecting the user's forearm from damage inflicted by an aggressor, and would assist the user in other ways, for instance a police officer would be able to use edge 14 of the device 10 to break a window and then rake the window frame with the outside portion or surface 60 of the device 10 so as to remove glass shards from the window frame.

Although this invention has been described above with reference to particular means, materials and embodiments, it is to be understood that the invention is not limited to these disclosed particulars, but extends instead to all equivalents within the scope of the claims which may be filed with any subsequent conventional patent application into which this application is converted.

I claim:

1. A wrist shield comprising:

a curved piece for fitting the underside of a human wrist, said curved piece having a wrist side surface and an outside surface, said curved piece being generally semi-cylindrical and having an axial length and a radius;

an elongated ridge protruding generally radially from said outside surface of said curved piece and extending generally axially along said curved piece, the ridge having a straight distal edge parallel to the axial length of said curved piece for striking an object; and a wrist attachment for attaching the wrist shield to a human wrist.

2. A wrist shield, as in claim 1, wherein said ridge has a length running parallel to said axial length of said curved piece and wherein said ridge length is shorter than said axial length of said curved piece.

3. A wrist shield, as in claim 1, wherein said ridge has a length running parallel to said axial length of said curved piece and wherein said ridge length is generally the same length as said axial length of said curved piece.

4. A wrist shield comprising:

a curved piece for fitting the underside of a human wrist, said curved piece having a wrist side surface and an outside surface, said curved piece being generally conical and having an axial length;

an elongated ridge protruding generally perpendicularly from said outside surface of said curved piece and extending generally axially along said curved piece, the ridge having a straight distal edge for striking an object; and a wrist attachment for attaching the wrist shield to a human wrist.

5. A wrist shield, as in claim 4, wherein said ridge has a length running parallel to said axial length of said curved piece which is shorter than said axial length of said curved piece.

6. A wrist shield, as in claim 4, wherein said ridge has a length running parallel to said axial length of said curved piece which is generally the same length as said axial length of said curved piece.

7. A method for preventing an aggressor from taking a user's holster-held firearm, the method comprising:

providing a wrist shield comprising a curved piece for fitting around a human wrist, said curved piece having a wrist side surface, an outside surface, a longitudinal axis, and a radial dimension, and the wrist shield further comprising an elongated ridge protruding generally radially from said outside surface and extending generally axially along said curved piece, the ridge having a distal edge extending parallel to the longitudinal axis of the curved piece;

securing the wrist shield around a user's arm near the wrist with the ridge positioned on the ulna side of the wrist; and when an aggressor reaches to remove a firearm from a holster on the user, moving said user's arm toward the aggressor so that the ulna side of the wrist moves swiftly toward an arm of the aggressor, and striking the aggressor's arm with the ridge.

8. The method of claim 7 wherein the shield comprises a single ridge and the ridge distal edge is straight.

9. The method of claim 7 wherein the ridge has a length running parallel to said longitudinal axis of said curved piece and said ridge length is shorter than said longitudinal axis of said curved piece.

10. The method of claim 9 wherein the ridge protrudes about ¼–¾ inches from said outside surface and wherein the ridge has a wide dimension transverse to said ridge length of about ⅛ inch.

11. The method of claim 7 wherein said ridge has a length parallel to said longitudinal axis of said curved piece and said ridge length is generally the same length as said longitudinal axis of said curved piece.

12. The method of claim 11 wherein the ridge protrudes about ¼–¾ inches from said outside surface and wherein the ridge has a wide dimension transverse to said ridge length of about ⅛ inch.

* * * * *